US005498178A

United States Patent [19]

Tabata

[11] Patent Number: 5,498,178

[45] Date of Patent: Mar. 12, 1996

[54] ELECTRICAL WIRE CONNECTING FIXTURE

[75] Inventor: Masaaki Tabata, Yokkaichi, Japan

[73] Assignee: Sumitomo Wiring Systems, Ltd., Japan

[21] Appl. No.: 330,332

[22] Filed: Oct. 27, 1994

[30] Foreign Application Priority Data

Nov. 17, 1993 [JP] Japan ..... 5-066466 U

[51] Int. Cl.[6] ..... H01R 4/42

[52] U.S. Cl. ..... 439/762; 439/756

[58] Field of Search ..... 439/761–774, 439/756

[56] References Cited

U.S. PATENT DOCUMENTS

| | | | |
|---|---|---|---|
| 1,976,941 | 10/1934 | Joy | 439/762 |
| 4,511,204 | 4/1985 | Glen | 439/807 |
| 5,088,941 | 2/1992 | Nolle | 439/762 |
| 5,302,143 | 4/1994 | Inoue | 439/762 |

FOREIGN PATENT DOCUMENTS

| | | |
|---|---|---|
| 2220890 | 10/1974 | France . |
| 3811629 | 11/1988 | Germany . |
| 4138547 | 11/1992 | Germany . |
| 4-118573 | 10/1992 | Japan . |

*Primary Examiner*—Neil Abrams

*Attorney, Agent, or Firm*—Jordan B. Bierman; Bierman and Muserlian

[57] ABSTRACT

This invention provides an electrical wire connecting fixture which can simplify a work of fastening an electrode and be easily made. The electrical wire connecting fixture for a battery, comprises: an electrode holder formed by bending a metal strip into a cylindrical body with open upper and lower ends; a pair of clamping pieces being extended in parallel to each other outwardly from the opposite ends of said electrode holder: a fastening bolt screwed in a given position of a bolt support piece adjustably in a vertical direction; and a slanting plate for bearing a lower end of the fastening bolt so as to approach the clamping pieces to each other when the fastening belt is screwed down. The bolt support piece is extended from one of the clamping pieces. The slanting plate is diagonally extended from the other of the clamping pieces in a direction perpendicular to the extending direction of the clamping pieces. When the fastening bolt is screwed down while the electrode holder engages with an electrode of a battery, the lower end of the bolt moves on the slanting plate. The other clamping piece united to the slanting plate approaches the one clamping piece to decrease an inner diameter of the electrode holder, thereby clamping the electrode of the battery.

7 Claims, 5 Drawing Sheets

ELECTRICAL WIRE CONNECTING FIXTURE

BACKGROUND OF THE INVENTION (1) Field of the Invention

This invention relates to an electrical wire connecting fixture which couples an electrical wire to a battery to be mounted in motor vehicles and the like.

(2) Statement of the Prior Art

For convenience of explanation, a conventional electrical wire connecting fixture for a battery will be described below by referring to FIG. 8. FIG. 8 is an exploded perspective view of a conventional electrical wire connecting fixture.

The conventional electrical wire connecting fixture shown in FIG. 8 is disclosed in Japanese Patent Public Disclosure No. 4-118573 (1992).

In the disclosed electrical wire connecting fixture, an electrode holder 1 is formed by bending a metal sheet to approach opposite ends thereof. The electrode holder 1 is provided on its opposite ends with a first slanting projection piece 2 and a second slanting projection piece 3. The pieces 2 and 3 are interconnected through their ramps.

The slanting projecting pieces 2 and 3 are provided with elongate holes 4 and 5 along the ramps. In the case of fastening the pieces 2 and 3, a bolt 6 is inserted into the elongate holes 4 and 5 and then fastened by a nut 7. However, the ramps are relatively displaced in a slanting direction during fastening. Consequently, an inner diameter of the electrode holder 1 is decreased.

The bolt 6 is screwed in the nut 7 to effect a clamping action in the electrode holder 1. Upon working, the nut 7 must be manually set under the pieces 2 and 3 in a narrow space. It is difficult to fit the nut 7 to the distal end of the bolt 6 in such a narrow space. Also, in the above construction, it is necessary to set ramps which contact with each other. Further, it is necessary to prepare the nut 7. The face contact of the ramps will impede a smooth fastening action. Accordingly, it is advantageous to simplify the construction.

SUMMARY OF THE INVENTION

An object of the present invention is to provide an electrical wire connecting fixture which enables simplified fastening of an electrode along with ease of manufacture.

In order to achieve the above object, the electrical wire connecting fixture for a battery in accordance with the present invention comprises: an electrode holder formed by bending a metal strip into a cylindrical body with open upper and lower ends; a pair of clamping pieces being extended in parallel to each other outwardly from the opposite ends of the electrode holder: a fastening bolt screwed in a given position of a bolt support piece adjustably in a vertical direction; and a slanting plate for bearing a lower end of the fastening bolt so as to approach the clamping pieces to each other when the fastening bolt is screwed down. The bolt support piece is extended from one of the clamping pieces. The slanting plate is diagonally extended from the other of said clamping pieces in a direction perpendicular to the extending direction of the clamping pieces.

When the fastening bolt is screwed down while the electrode holder engages with an electrode of a battery, the lower end of the bolt relatively moves on the slanting plate. The other clamping piece united to the slanting plate approaches the one clamping piece to decrease an inner diameter of the electrode holder, thereby clamping the electrode of the battery.

According to the electrical wire connecting fixture for the battery, since the bolt is merely screwed down from the upper position, it is not necessary to hold the nut or the like as the prior art. Thus, the fastening work can be simplified. Also, the construction becomes simple because no nut is used and only one ramp is formed. Resistance encountered upon working is reduced due to the contact between the bolt and the ramp, thereby smoothing the fastening work.

DETAILED DESCRIPTION OF THE PREFERRED EMBODIMENTS

Figure 1:
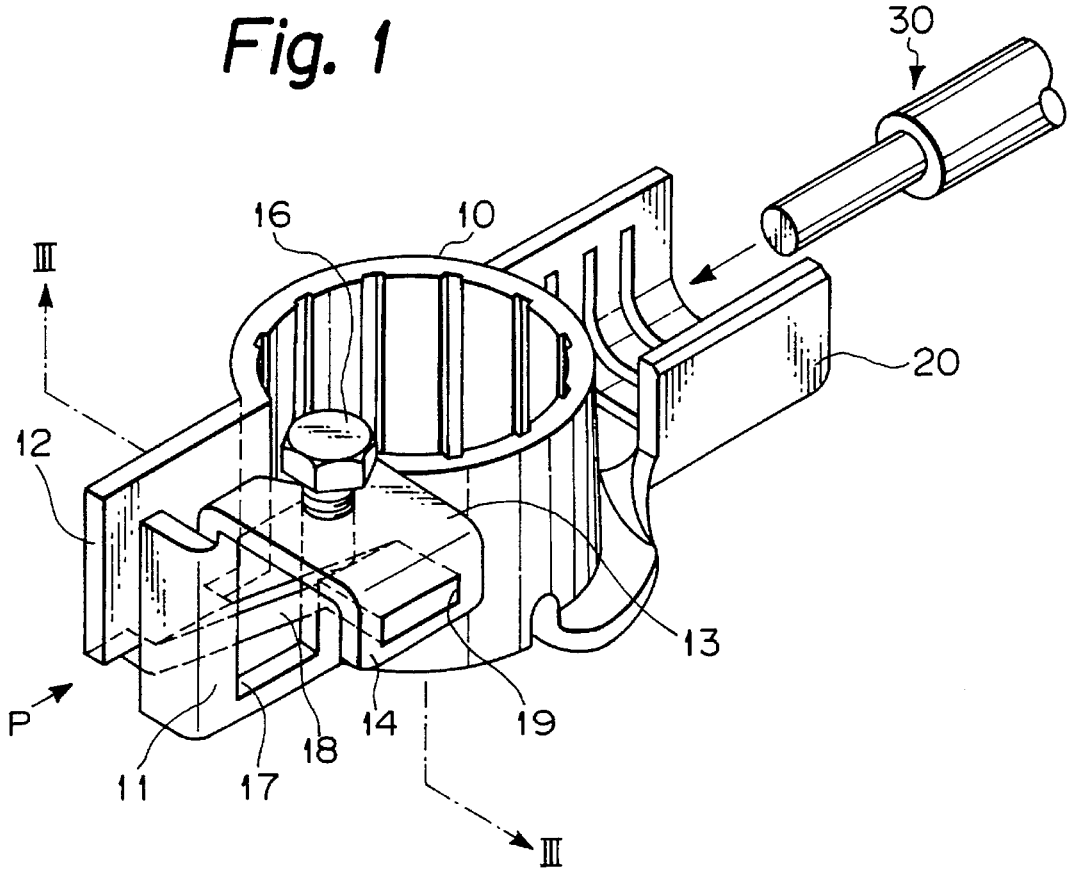
FIG. 1 is a perspective view of a first embodiment of an electrical wire connecting fixture for a battery in accordance with the present invention.

Referring now to the drawings, preferred embodiments of an electrical wire connecting fixture for a battery in accordance with the present invention will be described below.

<First Embodiment>

Figure 2:
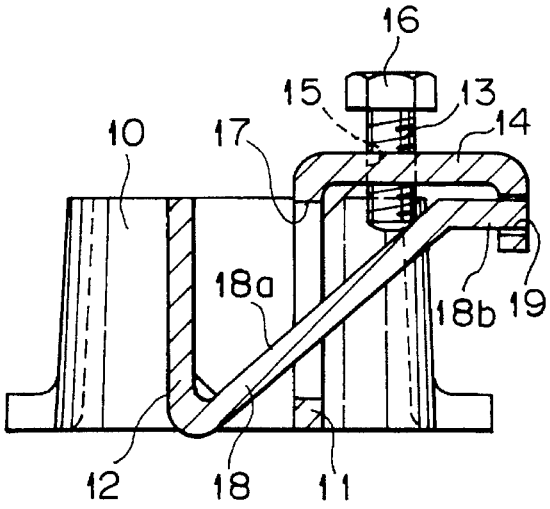
FIG. 2 is a cross sectional view taken along lines II—II in FIG. 1, illustrating a position prior to being fastened.
Figure 3:
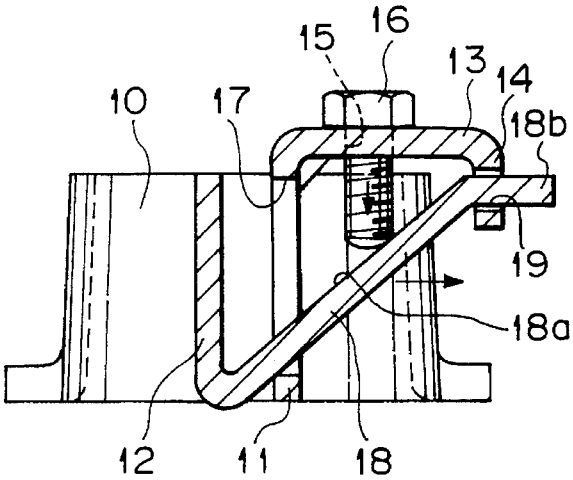
FIG. 3 is a cross sectional view taken along lines III—III in FIG. 1, illustrating a position after being fastened.

A first embodiment of the present invention will be explained by referring to FIGS. 1 through 3.

The connecting fixture in this embodiment is made of a conductive metal strip. The connecting fixture is provided on its center portion with an electrode holder 10 to be fitted to a terminal of a battery. The electrode holder 10 is formed into a cylindrical body with upper and lower openings. A pair of clamping pieces 11 and 12 extend from opposite ends of the cylindrical body. An upper end of one clamping piece 11 is bent outwardly and horizontally to form a bolt support piece 13. A slanting plate receiving piece 14 which hangs down from the bolt support piece is provided with a horizontal holding aperture 19. The bolt support piece 13 is provided with a female thread hole 15 adapted to be engaged with the bolt 16. The clamping piece 11 is also provided with an escape hole 17 which serves to allow displacement of a slanting plate described below.

The slanting plate 18 extends upwardly from a lower end edge of the other clamping piece 12 through the escape hole 17. The slanting plate 18 is provided on its end with an engaging piece **18*b* but horizontally therefrom. The engaging piece 18*b* is inserted into the holding aperture 19. Further, the slanting plate 18 has an upper contacting face 18*a* adapted to slidably contact with the bolt 16** upon fastening of it.

As shown in FIG. 1, the electrode holder 10 is integrally provided on its outside opposite to the clamping pieces 11, 12 with an electrical wire holding portion 20. The holding portion 20 is formed into a U-shape before being crimped around the wire 30 to clamp it.

Next, a process of fastening the electrical wire connecting fixture in this embodiment onto the electrode of the battery will be described below. When the fastening bolt 16 is screwed down into the female thread hole 15 in the bolt receiving piece 13 at a position shown in FIG. 2, the bolt 16 pushes a slidable contact face 18*a* at its lower end as shown in FIG. 3. At this time, the horizontal slanting piece 18*b* enters the horizontal support hole 19 so that the slanting plate 18 can bear the pushing force exerted by the bolt 16. Consequently, the slanting plate 18 is displaced to the left in FIG. 3 by a horizontal component of the pushing force acting on the upper contacting face 18*a*. Thus, the clamping piece 12 connected to the slanting plate 18 approaches the opposed clamping piece 11, so that the inner diameter of the electrode holder 10 is decreased to clamp the electrode. However, displacement of the clamping piece 12 is limited by an inner mouth of the holding hole 19 when the engaging piece 18*b* contacts with the mouth. It is possible to prevent the bolt 16 from being overfastened.

According to the electrical wire connecting fixture for the battery in the present embodiment, it is possible to attach the battery electrode merely by screwing down the fastening bolt. In particular, in a narrow space such as an engine compartment in which obstructions are common, downward fastening work is preferable from the viewpoint of efficiency. Also, in this embodiment, since the clamping piece 12 is merely provided with the contacting face 18*a* on which the bolt 16 slides upon fastening, the fixture can be easily produced. The contact between the bolt and the contacting face 18*a* reduces the fastening resistance and enhances the fastening action.

Figure 4:
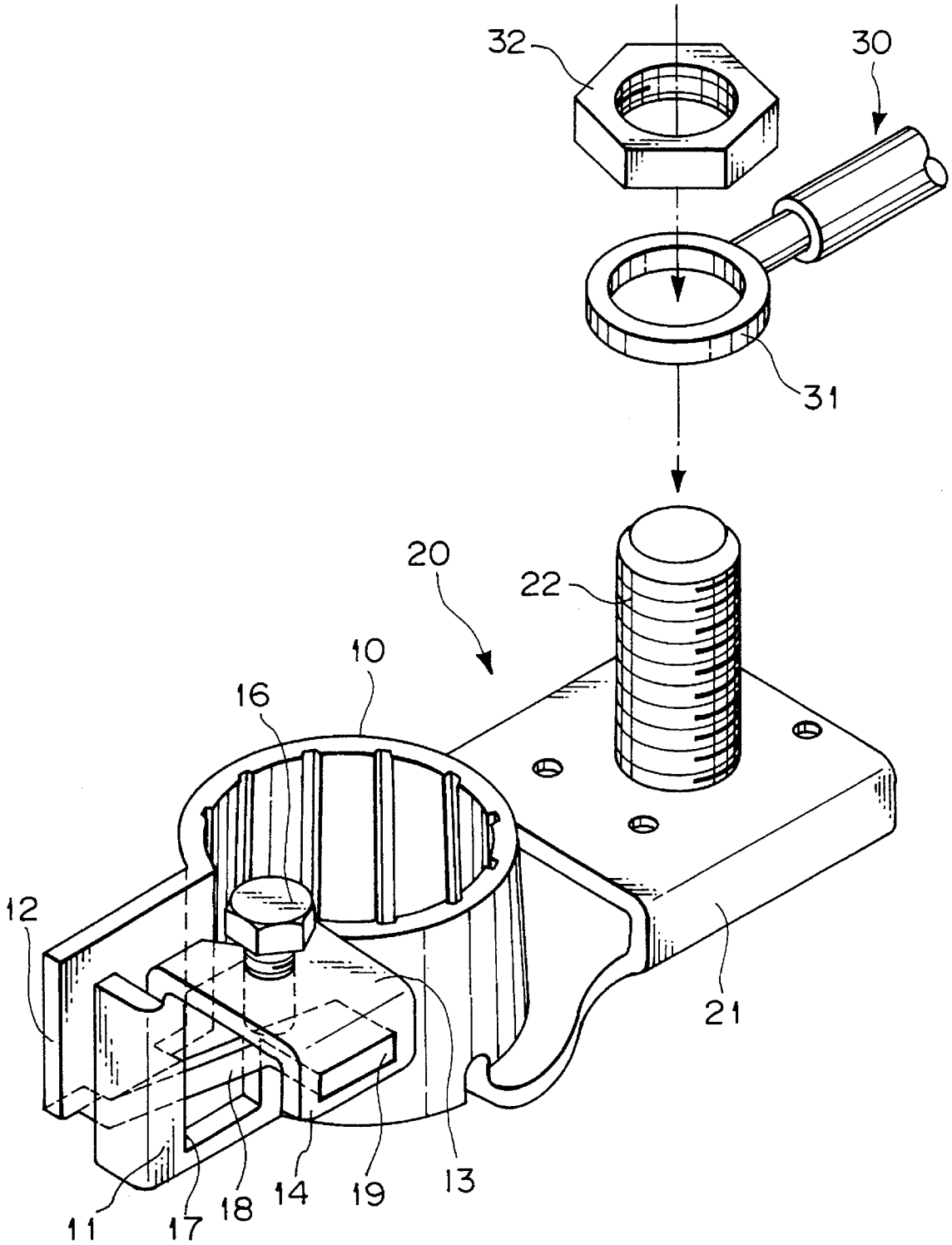
FIG. 4 is an exploded perspective view of another example of the first embodiment of the present invention.

The electrical wire holding portion 20 may be altered in various ways. For example, as shown in FIG. 4, the electrical wire holding portion 20 is integrally provided on its outside opposite edge to the clamping pieces 11 and 12 with an electrical wire connecting base plate 21 on which a screw rod 22 stands. In this case, an eye terminal 31 connected to the electrical wire 30 is coupled to the screw rod 22 and secured by a nut 32 thereto.

<Second Embodiment>

Figure 5:
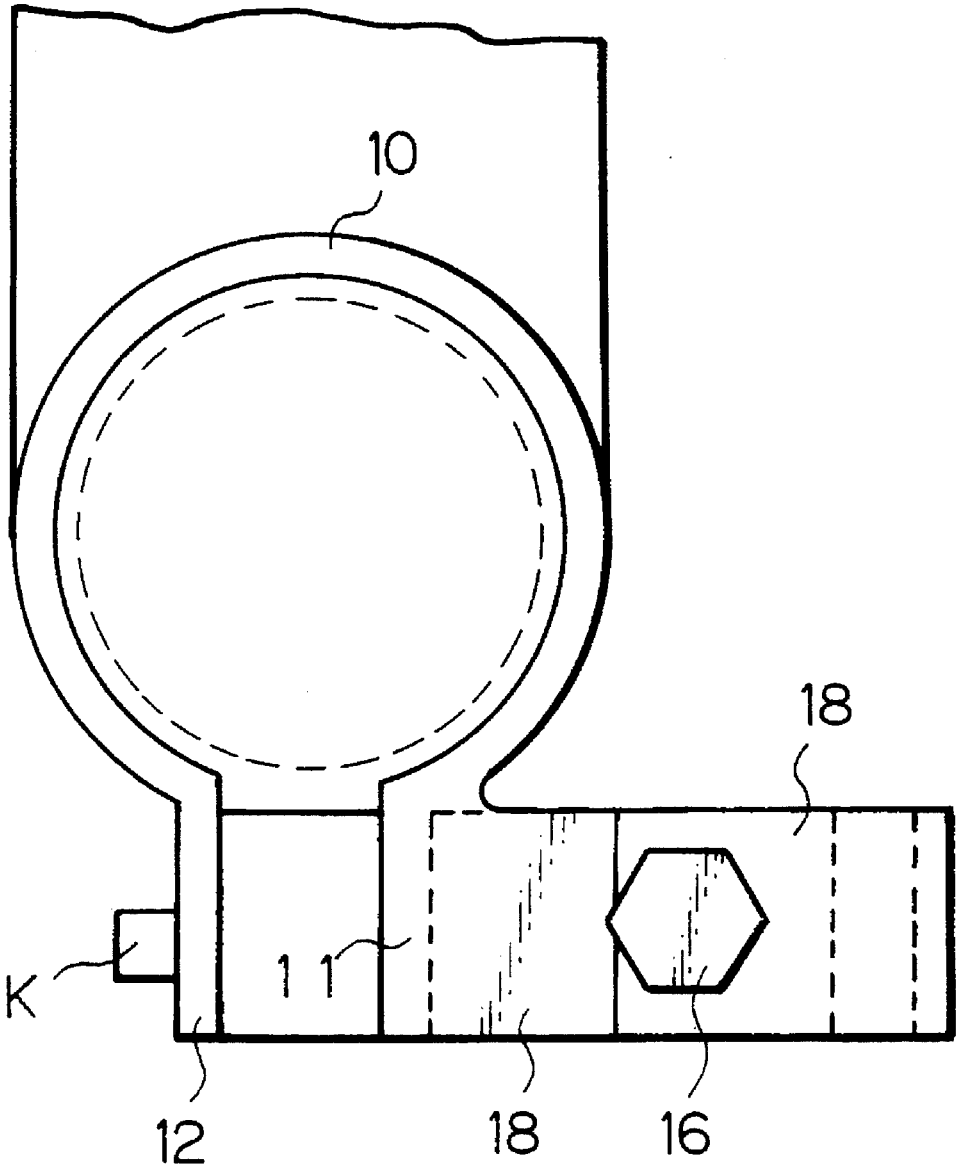
FIG. 5 is a plan view of a second embodiment of an electrical wire connecting fixture for a battery in accordance with the present invention.
Figure 6:
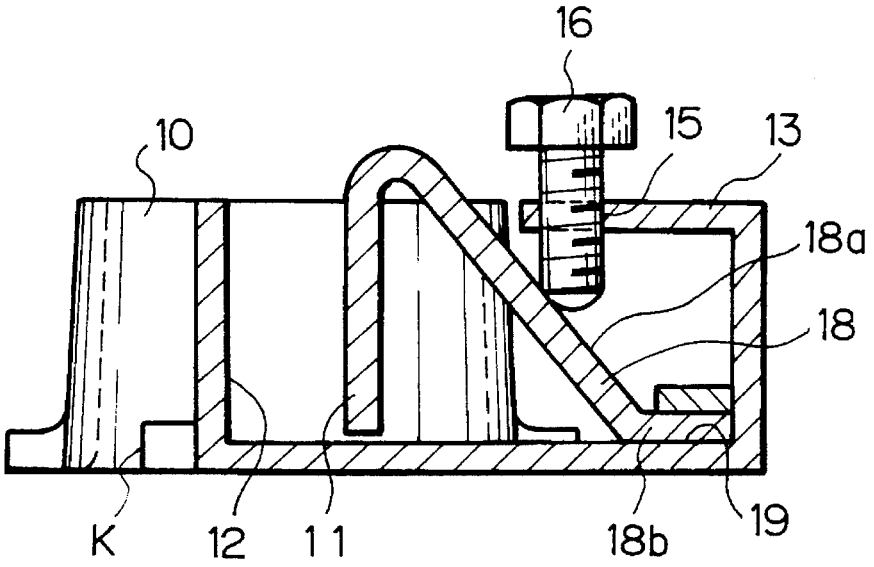
FIG. 6 is a cross sectional view of the second embodiment, illustrating a position prior to being fastened.
Figure 7:
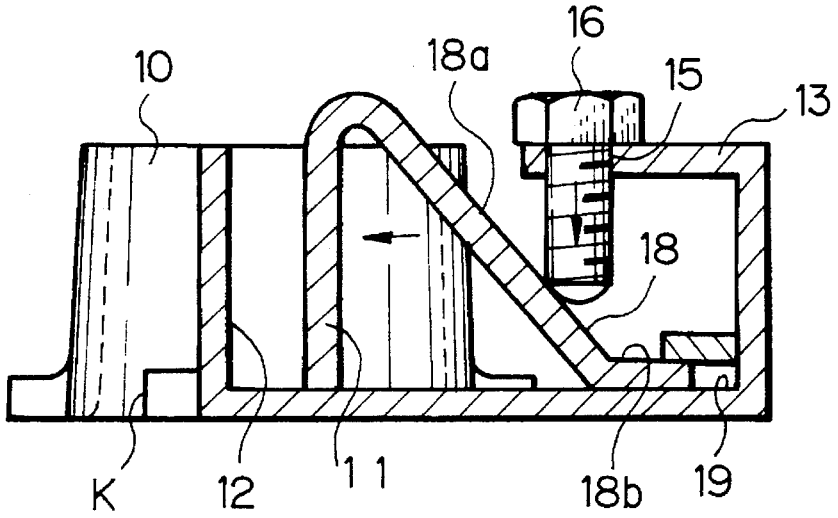
FIG. 7 is a cross sectional view of the second embodiment, illustrating a position after being fastened.
Figure 8:
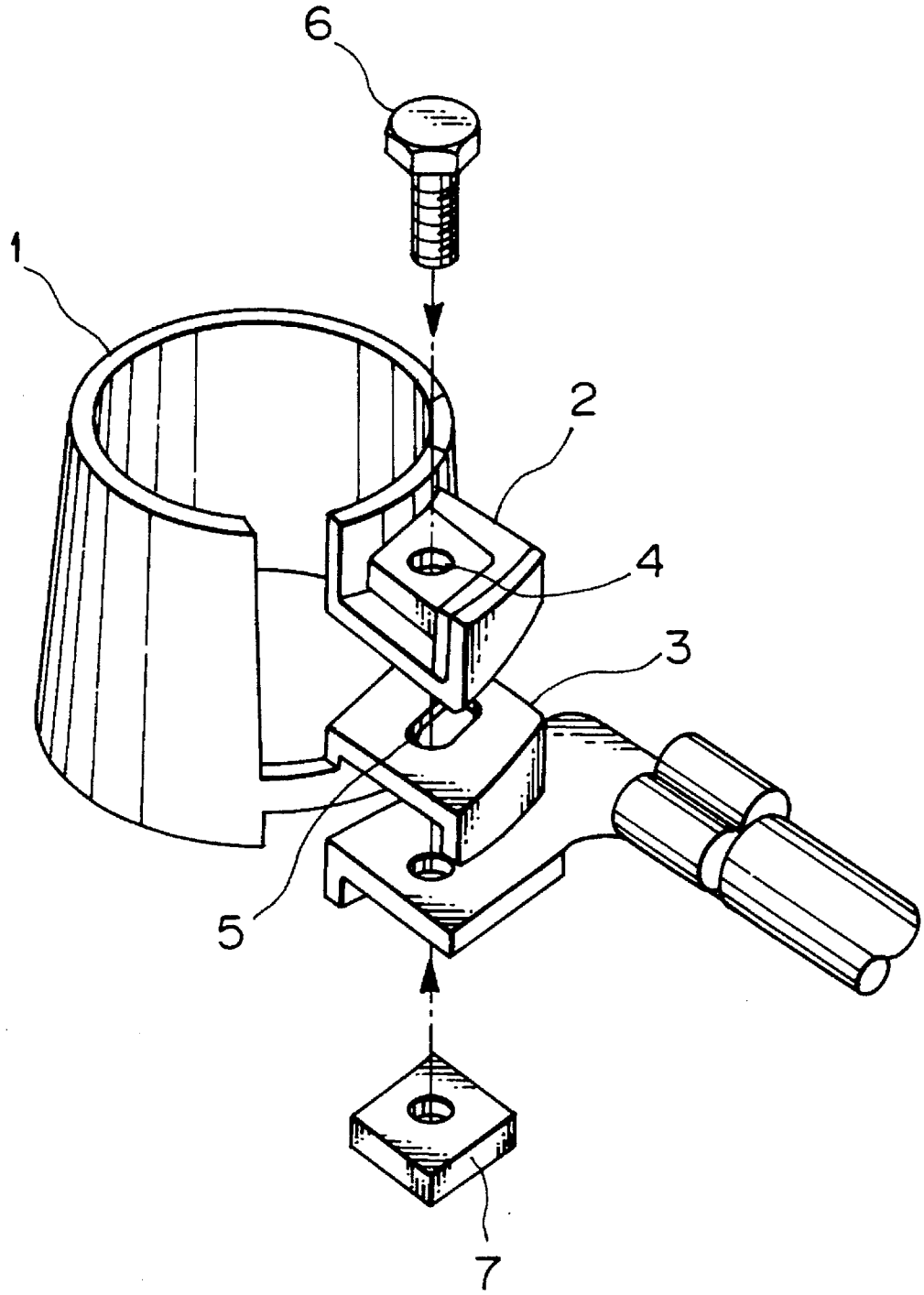
Fig. 8 PRIOR ART
FIG. 8 is an exploded perspective view of a conventional electrical wire connecting fixture for a battery.

A second embodiment of the present invention will be explained below by referring to FIGS. 5 through 7 with respect to differences between the first and second embodiments.

One clamping piece 12 of the electrode holder 10 is provided on its lower end with the bolt receiving piece 13 bent horizontally, outwardly vertically upwardly, and horizontally inwardly therefrom. The slanting plate 18 extends downwardly from the upper end of the other clamping piece 11. The distal end 18*b* of the slanting plate 18 enters the holding hole 19 when the electrode holder 10 is mounted on the battery.

The other constructions in the second embodiment are the same as those in the first embodiment.

When the fixture of the second embodiment is used, it is necessary to constrain the clamping piece 12 with no slanting plate 18 from being displaced. Accordingly, in the second embodiment, the battery is provided on its upper face with a stopper K so that it contacts with the outside of the clamping piece 12. Thus, when the bolt 16 is screwed down, the clamping piece 12 is preventing from moving rearwardly.

What is claimed is:

1. An electrical wire connecting fixture for a battery, comprising:

an electrode holder formed by bending a metal strip into a cylindrical body with open upper and lower ends;

a pair of clamping pieces being extended in parallel to each other outwardly from the opposite ends of said electrode holder;

a fastening bolt screwed in a given position of a bolt support piece adjustably in a vertical direction, said bolt support piece being extended from one of said clamping pieces; and a slanting plate for bearing a lower end of said fastening bolt so as to approach said clamping pieces toward each other when said fastening bolt is screwed down, said slanting plate being diagonally extended from the other of said clamping pieces in a direction perpendicular to the extending direction of said clamping pieces.

2. An electrical wire connecting fixture according to claim 1, wherein an upper end of said one clamping piece is bent outwardly and horizontally to form said bolt support piece, wherein said bolt support piece includes a slanting plate receiving piece which hangs down from said bolt support piece and is provided with a horizontal holding aperture, wherein said bolt support piece is provided with a female thread hole adapted to receive said fastening bolt, wherein said one clamping piece is provided with an escape opening adapted to allow displacement of said slanting plate, wherein said slanting plate extends upwardly from a lower end of said other clamping piece through said escape opening, wherein said slanting plate is provided on its distal end with a horizontal engaging piece adapted to be slidably inserted into said holding aperture, and wherein said slanting plate has an upper contacting face adapted to slidably contact with said bolt upon fastening of said bolt.

3. An electrical wire connecting fixture according to claim 2, wherein said electrode holder is integrally provided on its outside opposite to said clamping pieces with an electrical wire holding portion, and wherein said holding portion is formed into a U-shape before being crimped around said wire to clamp said wire.

4. An electrical wire connecting fixture according to claim 2, wherein said electrical wire holding portion is integrally provided on its outside opposite to said clamping pieces with an electrical wire connecting base plate on which a screw rod stands.

5. An electrical wire connecting fixture according to claim 1, wherein an upper end of said one clamping piece is bent outwardly and horizontally to form said bolt support piece wherein said slanting plate extends downwardly from an upper end of said other clamping piece, wherein said slanting plate has sufficient stiffness to bear a pressing force exerted by said bolt, wherein a stopper is provided on an upper face of a battery box to limit outward movement of said one clamping piece, wherein said bolt support piece is provided with a female thread hole adapted to receive said fastening bolt, and wherein said slanting plate has an upper contacting face adapted to contact with said bolt upon fastening of said bolt.

6. An electrical wire connecting fixture according to claim 5, wherein said electrode holder is integrally provided on its outside opposite to said clamping pieces with an electrical wire holding portion, and wherein said holding portion is formed into a U-shape before being crimped around said wire to clamp said wire.

7. An electrical wire connecting fixture according to claim 5, wherein said electrical wire holding portion is integrally provided on its outside opposite to said clamping pieces with an electrical wire connecting base plate on which a screw rod stands.

* * * * *